United States Patent [19]

Gärtner

[11] Patent Number: 4,606,508

[45] Date of Patent: Aug. 19, 1986

[54] BOBBIN INSERTING DEVICE

[75] Inventor: Günter Gärtner, Lucerne, Switzerland

[73] Assignee: Rieter Machine Works, Ltd., Winterthur, Switzerland

[21] Appl. No.: 611,852

[22] Filed: May 18, 1984

[30] Foreign Application Priority Data

May 20, 1983 [GB] United Kingdom ..... 8313994
Dec. 15, 1983 [GB] United Kingdom ..... 8333471

[51] Int. Cl.[4] ..... B65H 54/26
[52] U.S. Cl. ..... 242/35.5 R; 242/35.5 A
[58] Field of Search ..... 242/35.5 A, 35.5 R, 242/35.6 R, 18 DD, 18 PW; 57/279, 268, 269, 270, 305, 263

[56] References Cited

U.S. PATENT DOCUMENTS

| | | | |
|---|---|---|---|
| 3,168,257 | 2/1965 | Perry | 242/35.6 X |
| 3,791,126 | 2/1974 | Kose et al. | 242/35.5 A |
| 3,811,631 | 5/1974 | Mayer et al. | 242/35.5 A X |
| 3,940,077 | 2/1976 | Ohashi | 242/35.5 A |
| 3,971,520 | 7/1976 | Shimai | 242/35.5 A |
| 4,125,990 | 11/1978 | Stahlecker et al. | 242/35.6 R X |
| 4,138,839 | 2/1979 | Stahlecker et al. | 57/270 |
| 4,275,554 | 6/1981 | Tarbon et al. | 57/263 |
| 4,352,466 | 10/1982 | Baumges et al. | 242/35.5 A X |

FOREIGN PATENT DOCUMENTS

| | | | |
|---|---|---|---|
| 2640312 | 3/1978 | Fed. Rep. of Germany | 242/35.5 A |
| 2816418 | 10/1979 | Fed. Rep. of Germany | 242/35.5 A |
| 132269 | 10/1981 | Japan | 242/35.5 A |
| 2039552 | 8/1980 | United Kingdom | 242/35.5 A |

*Primary Examiner*—Stanley N. Gilreath
*Attorney, Agent, or Firm*—Kenyon & Kenyon

[57] ABSTRACT

The service tender is constructed so as to operate with cylindrical or conical packages which are wound on the yarn handling machine. The tender has a framework on which a subframe is pivotally mounted. For winding of conical packages, the sub-frame work is tilted at an angle which is half the cone angle of the conical package/conical bobbin.

14 Claims, 13 Drawing Figures

Figure 3:
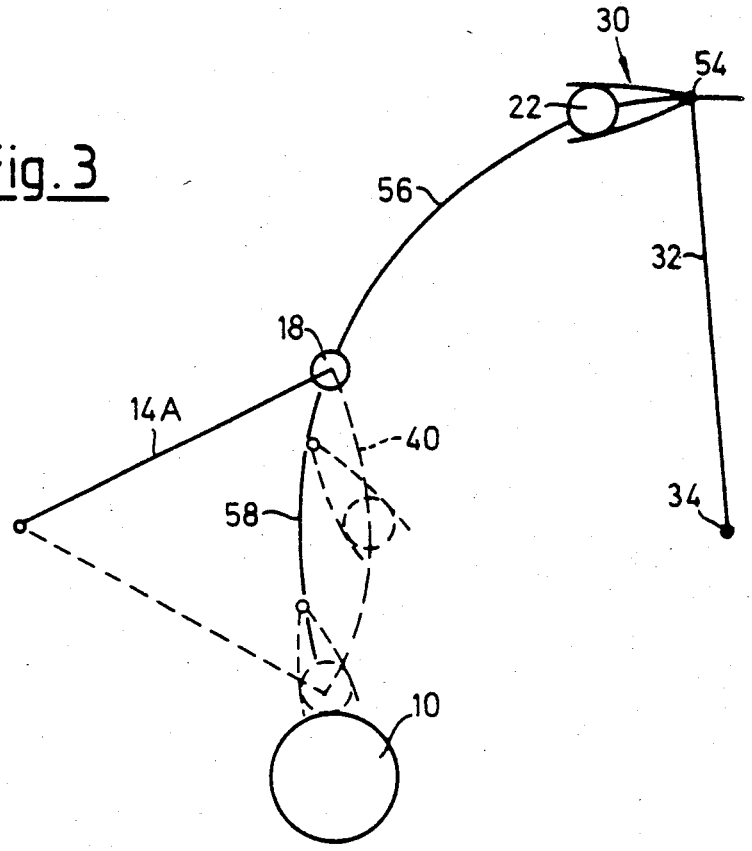

Fig.1
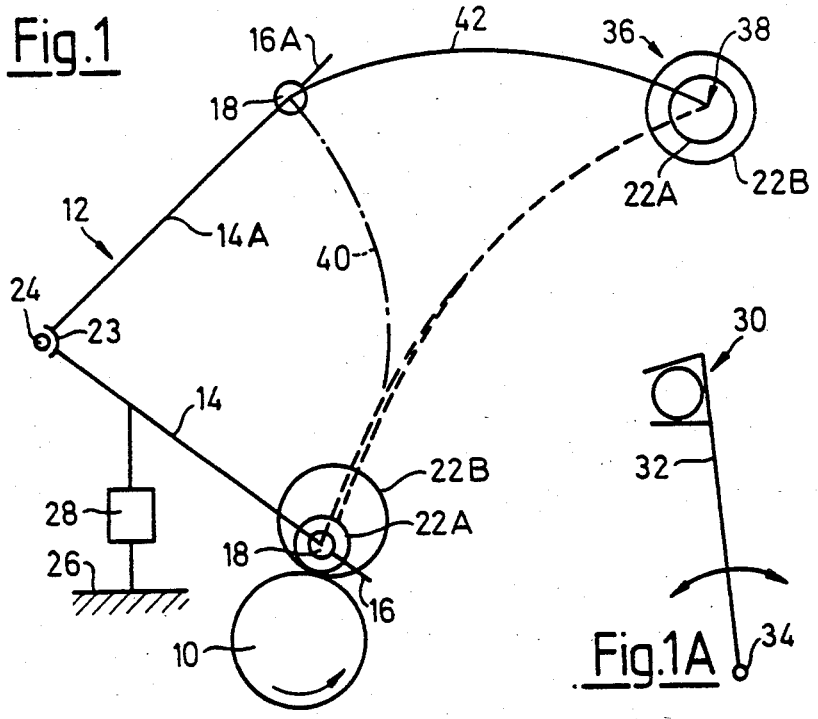
Fig.1A
Fig.2
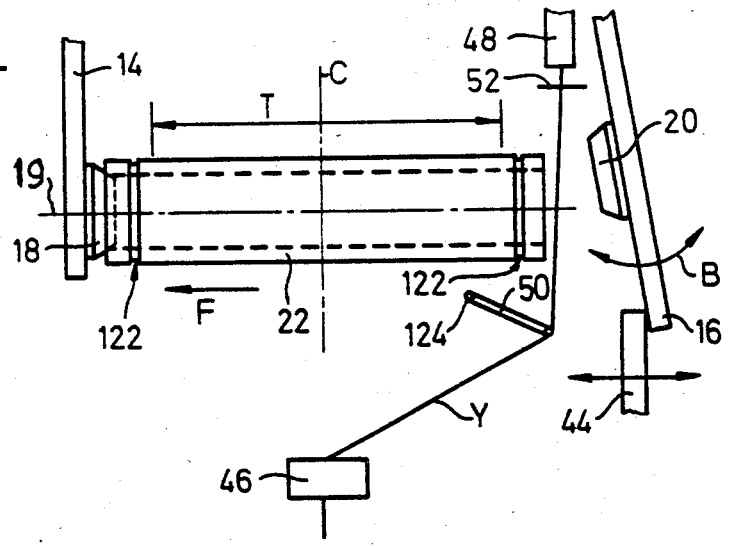

BOBBIN INSERTING DEVICE

This invention relates to a travelling service tender for yarn handling machines. More particularly, this invention relates to a service tender for a yarn handling machine capable of winding cylindrical packages and conical packages.

As in known, various types of yarn handing machines have been constructed with a plurality of operating stations for the winding of yarn. In many cases, each operating station includes a friction drive roll and a cradle means for holding a bobbin tube/yarn package in contact with the friction drive roll during formation of a yarn package on the bobbin tube. For example, such machines include rotor spinning machines, automatic rewinders for rewinding cops into cross-wound packages and false twist texturising machines. Examples of the wind-up apparatus can be found in German Patent Specification No. 2649156, British Pat. No. 1,399,891 and U.S. Pat. No. 3,356,306.

When starting winding at any one operating station, it is necessary to insert a bobbin tube into the cradle device and to connect a yarn to the inserted tube. It is now well known to perform such operations by means of a travelling service tender which is movable to and fro past the operating stations and can stop in alignment with any one of them to perform the required operations thereon.

It is also well known to provide such a tender with a bobbin inserting device in form of a pivotable arm provided at its free end with a bobbin gripper. Furthermore, the bobbin grippers have been provided with rollers to engage the bobbin tube so as to permit rotation of the tube while it is held by the gripper. This has been done for varying purposes; e.g. in U.S. Pat. No. 3,948,452, in order to enable acceleration of the incoming bobbin tube to the full winding speed; in German published patent application (Offenlegungsschrift) No. 2503545, in order to enable the start of winding of a new package to be effected practically simultaneously with the ejection of a full package and in German published patent application (Offenlegungsschrift) No. 3039857, to enable rotation of the incoming bobbin tube at a speed higher than the normal winding speed during formation of a thread reserve.

It has also been proposed in Swiss Pat. No. 625187 and U.S. Pat. No. 4,352,466 that the incoming bobbin tube should be transferred from the bobbin inserting device to the cradle mechanism at an intermediate position on the arc of swing of the cradle mechanism such that the bobbin tube is not then in contact with the friction drive roll. This enables temporary insertion of transmission rollers between the friction drive roll and the incoming bobbin tube, so that the tube can be rotated at a speed lower than the normal winding speed during formation of a thread reserve. The final stage of movement between the intermediate position and the normal winding position is effected only by movement of the cradle mechanism, the bobbin inserting device being withdrawn from contact with the bobbin tube.

CONICAL PACKAGES

Some of the above mentioned prior specifications show service tenders suitable for use with cylindrical yarn packages, and others show service tenders suitable for use with conical yarn packages. None of them shows a tender suitable for use selectively with either cylindrical or conical packages.

Further details of the invention will now be given by reference to the accompanying diagrammatic drawings, in which—

Figure 4:
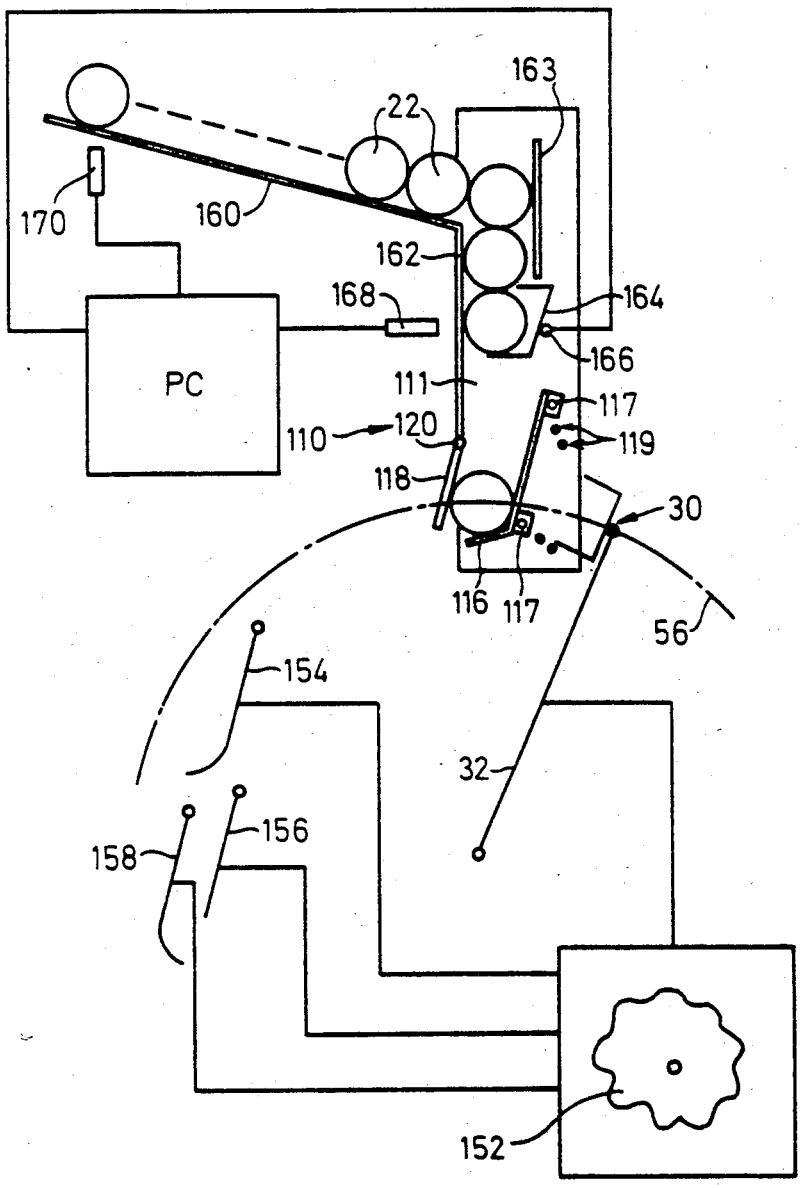
Figure 5:
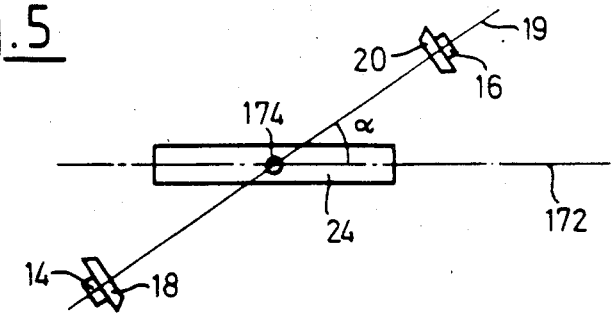
Figure 6:
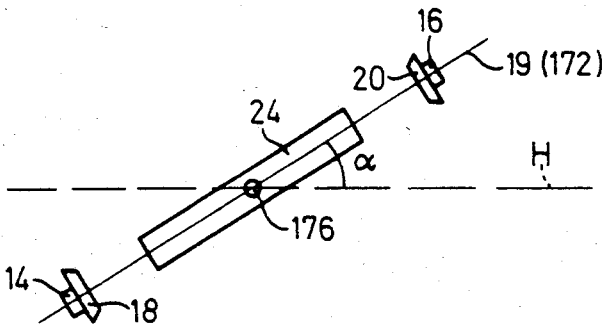
Figure 7:
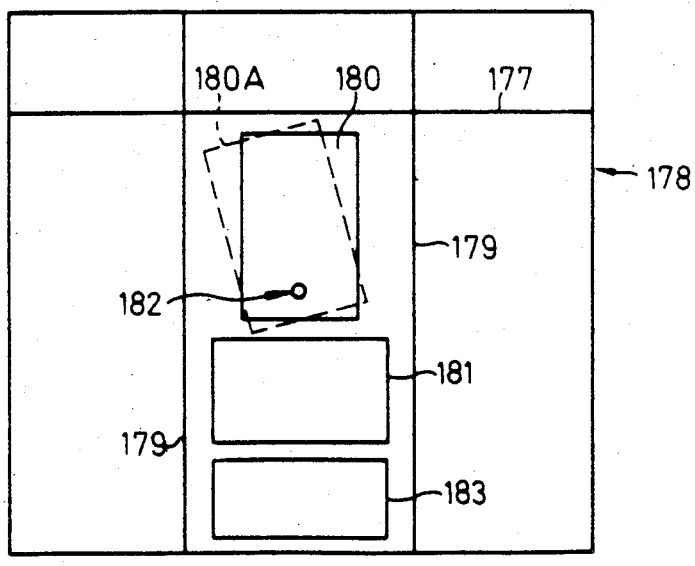
Figure 8:
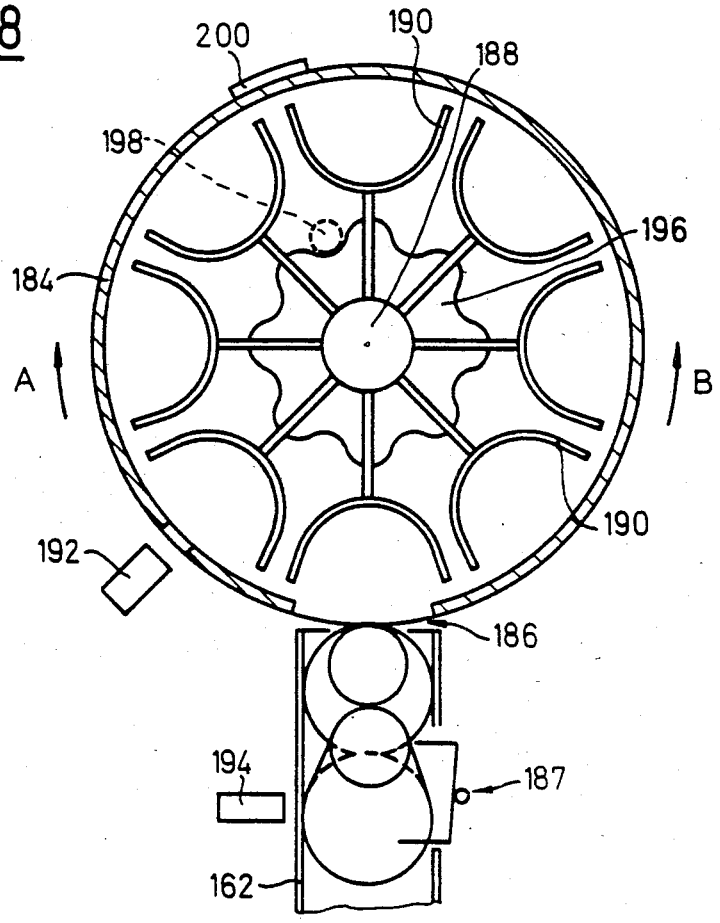
Figure 9:
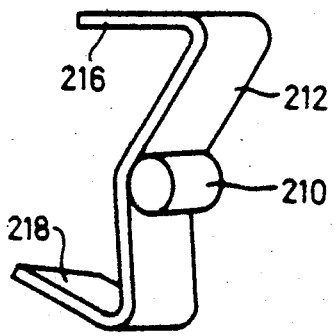
Figure 10:
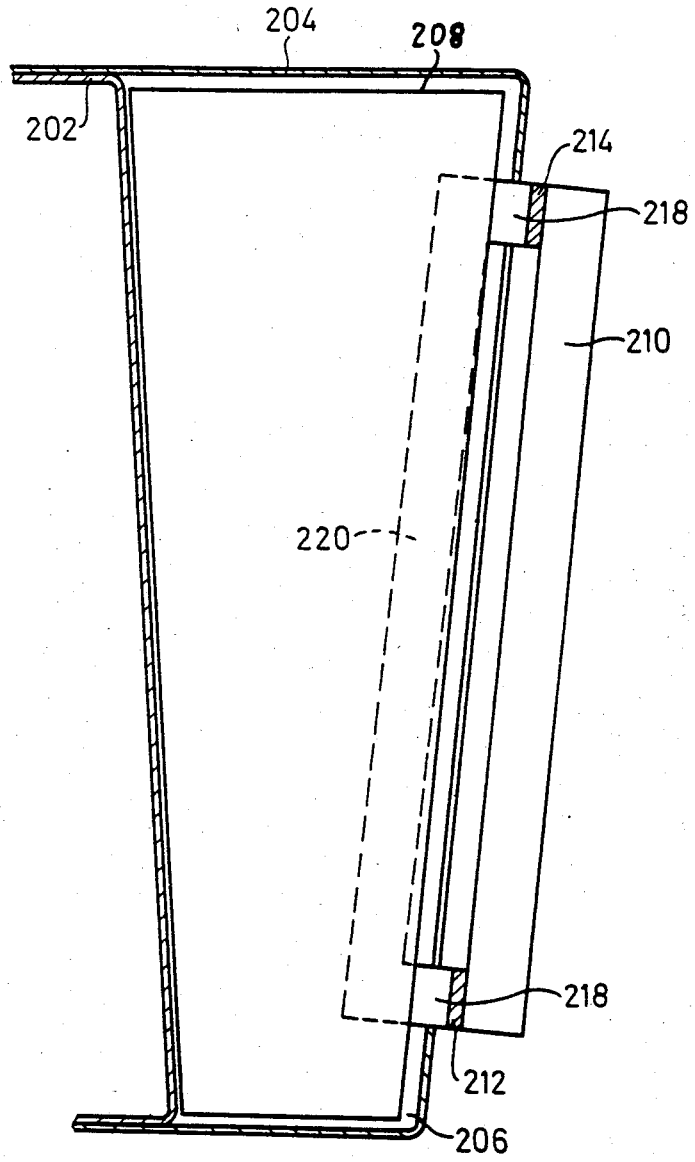
Figure 11:
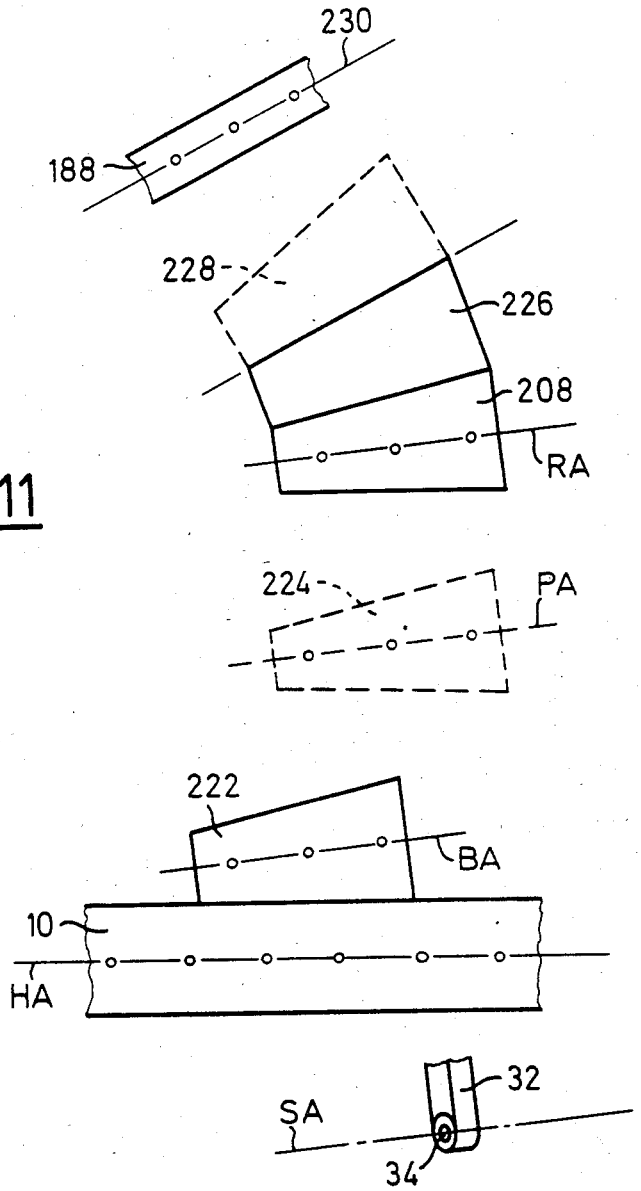

FIG. 1 is a diagrammatic representation of a cradle mechanism and a bobbin inserting system showing the effect of varying bobbin diameter, FIG. 1A diagrammatically illustrates a pivotally mounted bobbin gripper used in accordance with the invention, FIG. 2 is a more detailed (but still diagrammatic) view of part of a cradle mechanism in association with a thread reserve forming device, FIG. 3 is a diagram illustrating a second aspect of a bobbin inserting system, FIG. 4 is a diagram for use in explanation of a system for terminating winding at a selected station, FIG. 5 illustrates a system for enabling adaptation of a cradle mechanism for selective winding of either conical or cylindrical thread packages in accordance with the invention, FIG. 6 illustrates an alternative system for enabling adaptation of a cradle mechanism for selective winding of either conical or cylindrical yarn packages, FIG. 7 shows a diagrammatic elevation of a service tender adapted to service a yarn-handling machine having a system in accordance with FIG. 5, FIG. 8 is a section through a bobbin magazine suitable for conical bobbins, FIG. 9 illustrates a cross-piece used in a gate pivoting mechanism for a conical bobbin, FIG. 10 illustrates a chute and gate mechanism for a conical bobbin, FIG. 11 is a diagram for use in explanation of the geometry of a system handling conical bobbins.

Figure 12:
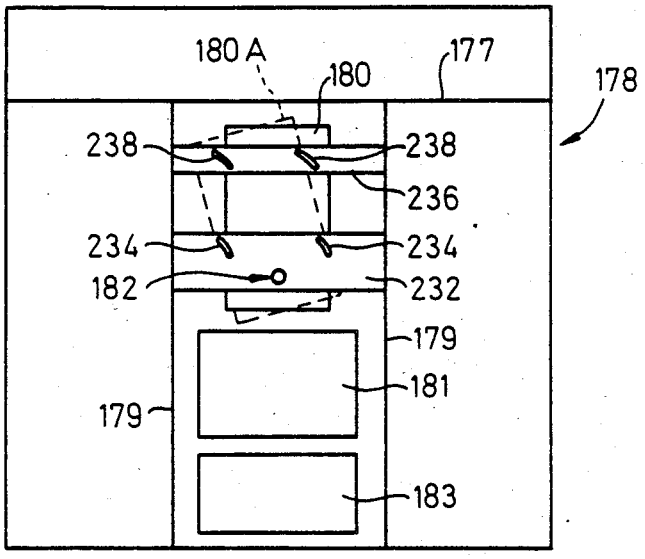

FIG. 12 shows further detail of a tender according to FIG. 7.

GENERAL

FIG. 1 shows in diagrammatic side elevation a friction drive roll 10 and a bobbin cradle mechanism generally indicated by the numeral 12. The cradle mechanism comprises a pair of arms 14, 16 which are aligned with one another as viewed in FIG. 1 so that only the nearer arm 14 is fully visible in that figure. Arm 16 is slightly longer than arm 14 so that its end portion can be seen in FIG. 1. Each arm carries a respective centering plate 18, 20 (better seen in FIG. 2) which in use carry between them a cylindrical bobbin tube 22.

Arms 14, 16 are carried by a carrier 23 (FIG. 1) which is pivotable about a bearing element 24 mounted in the machine structure. Arm 14 is fixed to the carrier, but arm 16 is pivotally mounted thereon for movement towards and away from the arm 14 as indicated by the double-headed arrow B in FIG. 2. Arm 16 has a normal position approximately parallel to arm 14 such that bobbin tube 22 is clamped between the plates 18 and 20. However, when arm 16 is pivoted away from arm 14 as shown in FIG. 2, a space is made for release of a yarn package formed on the bobbin tube 22 and/or insertion of a fresh bobbin tube between the centering plates.

Cradle mechanism 12 further comprises a cradle loading device 28 (FIG. 1). Device 28 is fixed at one end to the machine structure 26 and at the other end to the cradle comprising carrier 23 and arms 14,16. The loading device includes a biasing means (usually a spring-weighted device) which normally tends to draw the arms 14, 16 downwardly as viewed in FIG. 1 into a winding position in which a bobbin tube 22 carried by the arms engages the friction roll 10. Roll 10 is driven into rotation about its own longitudinal axis as indicated by the arrow in FIG. 1, and the plates 18, 20 are rotatable about axis 19 on the arms 14, 16 so that the bobbin tube 22 is rotated by frictional engagement with the roll 10. When a yarn is secured to the bobbin tube, therefore, it will begin to wind on the tube and a suitable traverse guide means (not shown) is provided to enable formation of a cross-wound package is a well-known manner. The arms 14, 16 can, however, be swung upwardly on the bearing element 24 to an uppermost position 14A, 16A in FIG. 1 and the loading device 24 has an over-centre system such that the weighting means is ineffective to draw the arms downwardly out of this uppermost position.

The arrangement thus far described is very well-known and widely used on several different textile machines, e.g. rotor spinning machines, automatic rewinding machines and false twist texturising machines. By way of example only, the arrangement as applied to open-end spinning machines can be seen in British Pat. No. 1349425.

In a practical yarn handling machine (whether a spinning machine, winding machine, texturising machine or any other type) there are normally a large number of operating stations arranged side by side along an elongated frame of the machine. In current machine design, up to 100 operating stations per machine side are common. Each operating station has its own cradle mechanism 12; the stations may also have respective friction drive rolls 10, or there may be a common roller extending for the full length of one machine side. It is now common practice to effect both package ejection and bobbin insertion automatically in such a machine so to reduce the manual attendance required. The devices required to perform these operations automatically may be provided at the individual spinning stations, but for economic reasons it is preferred to provide a service tender which is provided with one set of ejection/insertion devices and which is movable longitudinally of the machine past the stations. Means is provided to locate the tender in alignment with any selected station in order to enable performance of ejection/insertion operations thereon. In the following description, the use of a service tender will be assumed, but it will be apparent that the principles described could also be applied to multiple ejection/insertion devices.

BOBBIN INSERTION

Bobbin insertion is commonly effected by means of a bobbin gripper 30 (FIG. 1A) mounted at the end of an arm 32 which is pivotable about a pivot mounting 34 in the service tender. The gripper collects a bobbin from a bobbin holder (not shown) in an upper portion of its swinging movement about the mounting 34, and then moves the bobbin to a position at which the bobbin can be transferred to the cradle mechanism 12. The bobbin holder may be on the service tender or on the machine, but in the latter case one bobbin holder per operating station is required.

In many yarn handling machines, it is common practice to design the machine to accept bobbins of radically different external diameter. This provides substantially increased flxibility for the machine user in providing varying packages for varying end-user requirements. By way of example only, bobbin diameters used by spinning mills on rotor spinning machines may vary between approximately 60 and 105 mm. Assume now that a "bobbin collection position" 36 (FIG. 1) is defined at which the gripper 30 collects a bobbin presented to it by a suitable bobbin holder. Assume further that the holder is designed to hold all bobbin axes 38 at a predetermined location in the bobbin collection position, regardless of varying external diameters 22A and 22B respectively. It will be seen, however, that when these bobbins are in their respective winding positions in contact with the drive roll 10, their axes are spaced along the arc 40 swept out by the axis 19 during pivotal movement of the arm 14, 16. Accordingly, if the bobbin insertion device shown in FIG. 1A attempts to bring bobbins of varying diameters to their respective winding positions, for insertion into the cradle mechanism at those winding positions, then the movement mechanism for the bobbin insertion device requires adaptation in dependence upon the bobbin diameter and such system adaptation is highly undesirable since it involves complex movement setting operations. Further, the tender must control the cradle position.

The above disadvantages can be avoided by a system in which the bobbin insertion device does not insert bobbins into the cradle mechanism at the winding position, but at a "transfer location" which is spaced from the winding position. In the preferred embodiment shown in FIG. 1, this transfer location is defined by the uppermost position of the cradle. This uppermost position of the cradle (and, correspondingly, the transfer location) is the same for all bobbin diameters. It is not essential to use the uppermost position of the cradle to define the transfer location, which could be shifted along the arc 40 towards the friction roller 10 as far as the winding position of the largest diameter bobbin for which the machine is designed. However, the uppermost position of the cradle is preferred because it is a closely defined position in which the cradle is held in a stable condition without direct intervention of the service tender.

As indicated by the curve 42 ("bobbin insertion path") in FIG. 1, the path of movement of the bobbins between the collection position and the transfer location is the same regardless of bobbin diameter. Accordingly, while it is necessary to adapt the bobbin holder and the bobbin gripper to varying bobbin diameters, it is no longer necessary to adapt the movement defining system for the bobbin insertion device. The illustrated examples assume a pivotal movement for the bobbin insertion device, defining curved bobbin insertion paths. It will be apparent, however, that the principles are the same for a reciprocatory bobbin insertion device defining straight bobbin insertion paths.

In order to enable insertion of a bobbin into the cradle at the transfer location, the cradle must be "opened" i.e. arm 16 must be pivoted away from its normal, parallel di position relative to arm 14 to create space, so that the gripper 30 can bring the bobbin to a position in which the bobbin is substantially coaxial, with the axis 19 (FIG. 2). The cradle must then be "closed", i.e. arm 16 must be returned to its normal disposition so that the bobbin is clamped between the plates 18, 20. These movements of the arm 16 can be effected by a lever (not shown in FIG. 1) mounted in the service tender and operable by means to be described later. Such devices are now well-known in the art. An inserted bobbin is moved to its respective winding position by downward movement of the cradle from its uppermost position as viewed in FIG. 1. This movement can also be effected by a suitable lever provided on and operated by the tender. The bobbin insertion function of the gripper 30 is therefore completed when the bobbin is transferred to the cradle. However, for reasons which will now be explained, it may be desired to have the gripper hold the bobbin also in its winding position.

YARN CLAMPING

Consider now the diagram of FIG. 2 in further detail. The bobbin 22 is assumed to be already in its winding position in contact with the friction roller 10. However, the cradle is illustrated in its open or "release" condition with the arm 16 pivoted away from its normal disposition relative to the arm 14. Again, this is effected by a lever diagrammatically indicated at 44 in FIG. 2 mounted on and operated by the service tender. This re-opening of the cradle with the bobbin in the winding position enables extension of a yarn Y through the gap between the righthand end of bobbin 22 (as seen in FIG. 2) and the plate 20 on arm 16. If arm 16 is now returned to its normal disposition, this closing of the cradle will clamp the yarn Y between the bobbin end and the plate 20, thereby effectively securing the yarn to the bobbin for winding of a package thereon. Such clamping systems are well-known in the art.

Conveniently, the gripper 30 is used to hold the bobbin in the winding position during opening of the cradle in the course of the clamping operation. Although not illustrated in FIG. 2, the gripper 30 remains in gripping contact with bobbin 22 and urges it towards the left as viewed in that figure into continued contact with the plate 18. The clamping end of the bobbin (the righthand end as viewed in FIG. 2) is therefore accurately located during the clamping operation. A gripper design suitable for this purpose will be described in further detail later.

The yarn Y is commonly fed to the wind-up system from a guide system indicated generally by the numeral 46 in FIG. 2. When the yarn is secured to the rotating bobbin 22, the resulting yarn tension tends to draw the yarn into the shortest yarn path between the guide system 46 and the package forming on the bobbin 22. Normally, and in accordance with the assumption represented in FIG. 2, the shortest yarn path lies on the centre line C at the mid-length of the bobbin 22.

For purposes of securing the yarn to the bobbin 22 in order to start winding of a package, the yarn end is taken up by a yarn manipulating device 48. The form of this device will depend substantially upon the type of machine with which it is to be used. In a machine in which yarn is being forwarded towards the wind-up system (e.g. a spinning machine), the manipulating device 48 should also be a take-up device such as a suction pistol. Where yarn forwarding is dependent upon the wind-up itself, the manipulating device does not have to be a take-up. In any event, the manipulating device 48 is provided on and moved by the service tender.

Device 48 takes the yarn from the guide system 46 and extends it through the gap created by opening of the cradle between the bobbin 22 and the plate 20. The length of yarn which is to be clamped to the bobbin end should extend approximately at right angles to the axis 19. In order to ensure this, the yarn is acted on by auxiliary guide 50 which will be described in further detail below and which is also carried by the tender. As soon as the yarn is clamped to the bobbin by closing of the cradle, the length of yarn extending between the bobbin and device 48 is drawn by rotation of the bobbin against a knife edge indicated diagrammatically at 52. The knife is secured to the manipulating device 48 so that it remains spaced from the yarn until the latter is drawn into rotation. By this means, a short yarn tail is produced projecting from the clamping point, and the remainder of the yarn connected to device 48 is removed by the tender when it retracts the device 48 and knife 52.

MATCHING GRIPPER AND CRADLE MOVEMENTS

FIG. 3 shows the principle of matching of the gripper movement after bobbin insertion to the movement of the cradle between the transfer location and the bobbin winding position. The numerals used correspond with those used in description of FIG. 1, although the path of movement of the gripper 30 is different to that previously illustrated. There is an additional feature as compared with FIG. 1, namely that the gripper 30 is pivotally mounted on the arm 32 by a pivot mounting 54. Biasing means (not shown) hold the gripper 30 in a normal position relative to the arm 32, in which position the gripper 30 can collect a bobbin from the non-illustrated bobbin holder. Gripper 30 remains in this normal position during movement along the bobbin insertion path 56 from the collection location to the transfer location. Transfer of the bobbin from gripper 30 to the cradle is effected in the manner described above.

In FIG. 1, the bobbin inserting device would be retracted after insertion of a bobbin into the cradle. In FIG. 3, however, the anti-clockwise pivotal movement of the arm 32 continues even after bobbin insertion has been completed with the pivot mounting 54 moving along the extension 58 of the bobbin insertion path 56. The paths 56 and 58 can together be taken to define a "gripper path".

Simultaneously, the cradle is moved downwardly under the control of suitable levers on the tender to move the bobbin clamped therein from the transfer location to the winding position. The gripper path 56, 58 is arranged to intersect the arc 40 in the region of the bobbin winding positions. In this way, it is ensured that the gripper 30 is efficiently oriented relative to its arm 32 in order to hold the bobbin 22 in the winding position during the clamping operation as described with reference to FIG. 2.

In addition, however, it is desired to maintain a hold of the gripper 30 on the bobbin 22 between the transfer location and the winding position. This avoids any necessity for the gripper to re-grip the bobbin after it has arrived at the winding position. Such continued hold of the gripper on the bobbin during movement of the gripper along the path section 58 is enabled by pivoting of the gripper 30 on its pivot mounting 54 against the effect of its biasing means. The movements of the arm 32 and of the cradle lowering control lever on the tender can be coordinated by a suitable programming system (to be described further hereinafter) so that the bobbin clamped in the cradle remains within the holding range of the gripper 30 throughout movement of the latter along the path section 58.

During movement along the gripper path section 58 (FIG. 3), the path of the bobbin is determined by the cradle mechanism. However, the gripper maintains a hold on the bobbin throughout movement thereof from the transfer location to the winding position. The degree of pivot 60 reaches a maximum at the maximum spacing of the arc 40 and path 58, and the gripper 30 returns to its normal disposition, or a disposition very close thereto, as the bobbin reaches its winding position. The degree of pivot is exaggerated in FIG. 3 for ease of illustration of the principle.

TERMINATION OF WINDING

As previously described, the bobbin insertion device is commonly associated with a package ejector. The description thus far has concentrated upon bobbin insertion and has assumed that a fresh bobbin is required each time a package is ejected. This is not always the case. Eventually, winding will be terminated at at least one station, e.g. for maintenance purposes or for a change of yarn type to be handled or for other reasons. At this time, it may be desired to carry out a package ejecting operation without inserting a fresh bobbin.

The full set of equipment for operating on a wind-up means during package ejection/bobbin insertion may comprise a cradle operating means, a package ejecting means, a bobbin inserting device, and a yarn manipulating device. Assuming that these elements are mounted on a service tender, they will be movable relative to the tender between operative and inoperative positions, adopting their inoperative positions during running of the tender to and fro past the operating stations. Movements of the various elements to their operating positions, and their movements during the ejection/insertion operation are normally controlled by a sequence programming means. A practical form of such a programming means comprises a set of cam plates 152 (FIG. 4, only one cam plate visible) rotatable in unison about a common axis and coupled by suitable cam following lever systems to respective operating elements. The cam plate set functions simultaneously as a programming means and as a source of drive motion for the operating elements. The latter are represented in FIG. 4 by the bobbin inserting arm 32, a package ejection lever 154, a cradle operating lever 156 and a yarn manipulating lever 158. Each of the levers 154, 156 and 158 is pivotally mounted at one end in the tender structure (not shown) and its movements on its pivot mounting are controlled and effected by the set of cams 152.

In the system to be described, it is not necessary to provide a specific "termination" programme for operating only the package ejection functions without the bobbin insertion functions. All of the operating levers perform their normal ejection/insertion movements even upon winding termination. Insertion of a bobbin is prevented by preventing feed of a bobbin to the bobbin holder, for example, by means of an arrangement as shown in FIG. 4.

FIG. 4 shows an L-member 116 and retainer 118 for a bobbin. Body 110 includes side plates 111 which extend downwardly to or below the bobbin collection position. One side plate is assumed to be removed in the illustration of FIG. 4, so that the bobbin holder is visible.

Each L-member is secured to a respective side plate 111 by means of lugs 117 on the L-member and securing holes in the respective side plate. The appropriate securing holes are selected from an array of such holes 119 in dependence upon the required position of the L-member relative to the retainer 118, the pivot 120 of which is fixed to the same side plate. When the bobbin type is changed, the L-member can be released from its current securing holes and shifted to newly selected holes or replaced by a different size L-member held at newly selected holes.

Above the bobbin holder is a bobbin magazine in the form of an inclined plane 160 carrying a row of cylindrical bobbins 22. A wall 162 extends downwardly from plane 160 to pivot mounting 120. Wall 162 is fixed relative to the side plates 111 and forms the front of a feed chute directing bobbins from the plane 160 towards the holder. The back of the chute is provided by a wall 163 releasably secured to the plates 111 (for example, as described for L-member 116) and adjustable to adjust the size of the feed chute in dependence upon bobbin size. An upward extension of wall 163 forms a stop for the row of bobbins on plane 160.

Movement of individual bobbins along the chute is controlled by a selector gate comprising a U-shaped body 164 pivotally mounted at 166, so that either the one or the other arm of the U projects into the chute. Body 164 is biased by means not shown in a clockwise direction (as viewed in FIG. 8) on its mounting, 166, so that the lower arm of the U projects into the chute and retains a column of bobbins above itself. When the selector 164 is pivoted anti-clockwise (as viewed in FIG. 8) against the bias, the lower arm of the U is retracted so that the lowermost bobbin of the column is released and is permitted to pass into the holder 110. The upper arm of the U is, however, inserted between the released bobbin and the next bobbin in the column, so that the remainder of the column is retained. When the selector is permitted to return to its normal (illustrated) position, the column is permitted to fall onto the lower arm of the U, so that the system is ready for a repeat operation.

Pivotal movement of body 164 on mounting 166 is effected by any suitable drive means (not shown) controlled by an electronic programmable controller PC. This controller PC also controls the drive for the set of cams 152. Controller PC initiates operation of the cam set both during a normal ejection/insertion operation and during a termination operation. However, controller PC only operates the selector gate to feed a bobbin to holder 110 if PC receives an input signal during a doffing operation indicating normal ejection/insertion. If a termination operation is signalled, the selector gate is not operated and holder 110 remains empty. This has the additional advantage that holder 110 remains empty during each return swing of the arm 32, so that gripper 30 can pass freely between leg structures 112, 114 on each return swing.

The detectors 168 and 170 respectively are provided to sense the "level of fill" of the magazine. Detectors 168, 170 are desirably light barriers adapted to beam across the row of bobbins, but any other, detectors sensitive to the presence of bobbins can be substituted. The detector 168 is associated with the gate means. In operation, the gate can be maintained full in readiness for a feeding operation. If detector 168 senses that no bobbin is received by the member 164 when pivoted to its normal position, the detector sends a signal to controller PC which thereupon blocks further ejection/insertion operations and causes the service tender to travel to a loading position (not shown) at which further bobbins can be loaded into the magazine. Detector 170 functions similarly to detect the "full" condition of the magazine, controller PC duly responding to terminate the loading operation. Signals from the controller to the loading station can be transmitted via a cable connecting the tender to the machine, and thus to the loading station.

CONICAL/CYLINDRICAL BOBBINS

For ease of description, the previously illustrated embodiments have assumed that the machine is producing cylindrical packages so that the tender is handling cylindrical bobbins. This is not essential to the invention. The principles already explained are equally applicable where the machine is producing conical packages so that the tender is required to handle conical bobbins.

In design of some types of yarn handling machines, e.g. for open end spinning machines, it is now current practice to design the wind-up section to be adjustable to enable the machine to produce selectively either cylindrical or conical packages. FIGS. 5 and 6 illustrate the principles involved in two methods for enabling such adaptation. FIG. 5 illustrates the mounting 24 (see also FIG. 1) by means of which the package cradle is secured in the machine structure. Numeral 172 indicates the swing axis about which the cradle pivots to produce the arc of movement 40 shown in FIG. 1. Axis 172 is illustrated horizontal, parallel to a horizontally disposed friction drive roller 10 (see FIG. 1, not shown in FIG. 5).

In the system diagrammatically illustrated in FIG. 5, this axis 172 is assumed to be maintained horizontal even for production of conical packages. The cradle itself is, however, pivoted relative to the mounting 24 about a pivot 174 so that the axis 19 (see also FIG. 2) which joins the bobbin clamping plates 18 and 20, is inclined at an angle $\alpha$ to the axis 172. Angle $\alpha$ is half the cone angle of the conical package/conical bobbin, enabling the conical bobbin to engage the horizontal friction roller along the full length of the bobbin. This is the adjustment principle used, e.g. in the system shown in German Patent Specification No. 653759.

In FIG. 6, the line H represents a horizontal corresponding with the axis 172 for winding of cylindrical packages. For winding of conical packages, however, the mounting 24 is tilted to an angle $\alpha$ relative to this horizontal H, the axes 19 and 172 remaining parallel. In FIG. 6, the adjustment is assumed to occur by pivoting of mounting 24 about a pivot mounting 176 intersected by the axis 172. This is not necessary. As shown, e.g. in British Patent Specification No. 1344226, the mounting 24 (and with it the cradle) can be pivoted about a pivot mounting displaced from the axis 172—the said specification proposes a horizontal axis tangential to the friction drive roll. The disclosure of German Patent Specification No. 653759 and British Patent Specification No. 1344226 are hereby incorporated in the present specification by reference.

By whichever system the machine is adapted to produce alternatively cylindrical and conical packages, the service tender can be correspondingly adapted. This will be illustrated by reference to FIG. 7 showing the organisation of a multi-purpose service tender for use with a rotor spinning machine.

The rotor spinning machines (not shown) are of the type shown, for example, in U.S. Pat. No. 3,375,649. Each spinning station comprises a spinning unit, a yarn forwarding section for withdrawing yarn from the spinning unit and a wind-up section for forming the withdrawn yarn into a package. The wind-up section is located above the spinning unit.

The tender has a main framework 178, horizontally divided at line 177 into an upper suspension/drive section above line 177 and a depending section which contains the operating elements. Section 177 runs on a rail (not shown) to move the depending section past the spinning stations. The framework is vertically divided by bulkheads 179 into three portions. The operating elements are contained in the central portion, drives therefor are provided in one of the side portions and other "utilities" (e.g. suction systems, electronic controls) are provided in the other side portion.

The tender is assumed to be of the multi-purpose type designed to perform both piecing and doffing functions on the spinning stations. At least some of the function elements designed to operate on the wind-up sections of the stations are carried by sub-frame 180, function elements designed to operate between the wind-up sections and the spinning units are carried by a sub-frame 181 and function elements designed to co-operate directly with the spinning units are carried by a sub-frame 183.

Sub-frame 180 is pivotable in the main framework and is located in the full-line position for winding of cylindrical packages. For winding of conical packages, the sub-framework is tilted about an axis 182 into the dottedline position 180A. When the tender is located in registry with an operating station, the axis 182 is coaxial with the pivot axis of the pivot mounting at which the wind-up section of the operating station is adjusted to enable it to wind conical packages. In the case of FIG. 5, therefore, axis 182 is co-axial with the pivot axis of mounting 174, in the case of FIG. 6 with the pivot axis of mounting 176, and in the case of the system shown in British Patent Specification No. 1344226, axis 182 is co-axial with the horizontal adjustment axis tangential to the friction drive roll.

The angle through which sub-frame 180 is adjusted corresponds, of course, to the angle $\alpha$ shown in FIG. 5. Details of the mounting system enabling pivoting of the sub-frame 180 have not been shown in FIG. 7; many suitable systems will occur to machine designers, and need not be explained in detail here.

The sub-frame 180 carries those operating elements of the service tender which co-operate with the adjustable wind-up section of the machine; and which must be adjusted in order to deal with conical bobbins and packages. Where the service tender is of the multi-purpose type, being designed to perform both yarn piecing and package doffing operations, then sub-frame 180 may also carry operating elements used in the piecing operation; e.g. a package rotating roller carried by the tender and extendable therefrom into contact with the package to rotate the latter in the reverse direction to provide a "seed" yarn for piecing in an open end spinning machine.

MAGAZINE FOR CONICAL BOBBINS

The magazine shown in FIG. 4 must also be adapted if the tender is to be used with a machine producing conical packages, since conical bobbins will not roll satisfactorily down the inclined plane 160 suitable for cylindrical bobbins. FIG. 8 shows a drum-type magazine which can be substituted for the magazine of FIG. 4, the feed chute and the holder 110 remaining substantially the same. Drum-type magazines are not as such novel—see for example Japanese Published Patent Specification No. 47-25811. Such magazines present, however, a number of problems regarding control of bobbin movements into and out of the magazine, and the illustrated system shows elegant solutions to these problems.

The outer shell 184 of the magazine is cylindrical and is fixed relative to the chute, having an opening 186 in alignment with the chute. A gate means 187 similar to the gate shown in FIG. 4 is located adjacent the junction between the chute and shell 184. Gate 187 is normally biased into the illustrated disposition in which it retains a first bobbin while a second bobbin rests on the first.

Co-axial with shell 184 is a rotary member 188 carrying a plurality of bobbin receiving elements 190 at its periphery. Each element 190 is U-shaped in section, with the open side of the U facing radially outwardly towards the shell 184. The elements 190 are so located relative to shell 184 that a bobbin of predetermined size can be neatly received in the compartment defined between one element 190 and the shell. Member 188 is rotated about the axis of shell 184 by any suitable stepping drive means (not shown). The stepping drive means locates elements 190 successively in alignment with opening 186.

When gate 187 is operated to release the bobbin retained therein, the upper arm on the gate prevents the second bobbin falling until the gate returns to its normal disposition to retain the new bobbin. The stepping drive is then operated to align another element 190 with the opening 186. Assuming the newly arrived element 190 carries a bobbin, the latter falls into the chute to rest on the bobbin currently held by the gate mechanism.

Assume that member 188 is rotated in the direction of the arrow A in order to bring the compartments successively into alignment with opening 186 in order to feed bobbins to the holder 110. A bobbin detector 192, e.g. a light barrier type of detector, is located in association with the compartment next to the opening 186, considered in the direction of rotation indicated by arrow A. As before, a bobbin detector 194 is associated with the gate 187, and the gate is normally maintained full so that a "bobbin absent" signal from detector 194 indicates that the magazine is empty. The signal is passed to controller PC (FIG. 8) which causes the tender to move to a magazine loading position at one end of the machine. Additionally, each time the tender arrives at the one end of the machine and a "bobbin absent" signal is being produced by detector 192, the controller PC (which receives signals indicating arrival at the machine end) causes the tender to move to the magazine loading position even if the magazine is still part full, i.e. even if a "bobbin present" signal is received from detector 194. Thus the magazine is "topped up" each time the tender moves to the said machine end.

Assume the magazine is empty. When the tender is in the magazine loading position, a signal is sent to the loading station causing it to load a bobbin into the compartment associated with detector 192. The bobbin is loaded into the compartment by movement longitudinally of the compartment axis, the end face of shell 184 being open to permit this loading movement. The controller now causes the stepping drive to index member 188 through one step in the direction of arrow B shown in FIG. 11, i.e. in reverse relative to the normal bobbin feed direction. Gate 187 is in its normal position (illustrated) to take the newly loaded bobbin. Meanwhile, controller PC will be receiving a "bobbin absent" signal from detector 192 and will cause the loading station to load a second bobbin into the compartment now associated with detector 192. Member 188 is then indexed through a further step in the direction of the arrow B, so that the second bobbin falls onto the first, that is the system is in the actually shown condition.

The loading/stepping operation is then repeated, because detector 192 is still providing a "bobbin absent" signal. The number of repeats is dependent upon the capacity of the magazine, the process being repeated until detector 192 provides a "bobbin present" signal after stepping of the member 188. The second-loaded bobbin is so disposed in the chute, and the elements 190 are so disposed relative to the chute, that the third-loaded bobbin and subsequently loaded bobbins make line contact with the second-loaded bobbin during the stepping movements. Thus, during these stepping movements, the opening 186 is effectively "closed" (as far as the third and subsequently loaded bobbins are concerned) by the second-loaded bobbin.

Assume now that a "topping up" operation is to be carried out with the magazine partly full i.e. the tender arrives at the loading position with at least gate 187 and possibly some magazine compartments still occupied. The loading/stepping operation can be carried out exactly as for refilling of an empty magazine i.e. by reference to the output of detector 192; the number of bobbins loaded may be anywhere in the range 1 to $(n+1)$, where n is the number of elements 190, depending on the level of fill before the start of loading.

It is not, of course, essential to rotate member 188 in opposite directions for purposes of bobbin feeding and bobbin loading, but this step shortens the time needed to top up a partly full magazine. While not essential the "normally full" condition of the gate is, of course, desirable because it increases the capacity of the magazine.

An indexing mechanism is preferably provided to ensure that at the end of each rotation step one of the compartments is accurately aligned with the opening 186. A suitable arrangement is illustrated in dotted lines in FIG. 8. As shown, member 188 is associated with a rotary plate 196 having a plurality of recesses corresponding respectively with the elements 190. A spring bias roller 198 secured (by means not shown) to the tender frame, engages successively in the recesses of plate 196 as the latter rotates with member 188 thus locating the member in successive positions determined by the co-operation of the roller and the recesses. A detector 200 responsive to a predetermined part of the member 188, e.g. the adjoining region between two successive elements 190, can be provided to indicate rotary alignment/misalignment of the member 188, and the controller PC can respond in accordance with a predetermined programme when a misalignment is indicated.

The drum-type magazine could, of course, be used with cylindrical bobbins. However, the much simpler form of magazine illustrated in FIG. 4 is preferred wherever possible. The non-illustrated stepping mechanism could, for example, comprise a piston and cylinder unit adapted to pivot a pawl-like element co-operable with the indexing member 196. There may be two such piston and cylinder units, each with its respective pawl element for driving member 188 in the directions of arrows A and B respectively. Any alternative stepping mechanism could, of course, be used instead. The end faces of the drum may be closed except where an opening is left to enable loading of bobbins into a compartment aligned with the detector 192. This latter opening may be normally closable, but full closure of the end faces may in any event prove unnecessary since the bobbins are not normally subjected to any axial movement when located in their compartments.

GEOMETRY

The geometry of a complete system for handling conical bobbins is dependent on a number of design factors and is therefore variable in dependence upon desired operating conditions. An advantageous layout will be explained by way of example with reference to the diagram in FIG. 10. In that Figure, friction drive roll 10 is shown with its horizontal longitudinal axis HA. This axis is fixed for both cylindrical and conical packages.

A conical bobbin 222 is shown in the winding position.

Its axis BA is inclined at the angle $\alpha$ to the horizontal so that the bobbin makes line contact with the drive roll.

The position in which bobbins are presented to the bobbin insertion device, i.e. the collection position, is indicated in dotted lines at 224. The bobbin axis at the collection position is indicated at PA and is parallel to the axis BA.

The axis of swing of the arm 32 of the bobbin insertion device is indicated at SA. Due to the adjustment of the sub-frame 180 as described with reference to FIG. 10, axis SA is parallel to axes BA and PA.

A bobbin 208 is shown in the position in which it is held by the gate mechanism ready to fall to the position 224. The bobbin axis RA in this "ready" position is parallel to the axis PA. The ready position shown in FIG. 14 is preferable because it requires no tilt of the incoming bobbin about its larger diameter end in passing from the gate to the position 224.

A bobbin 226 is shown resting on the bobbin 208. The position of the axis of bobbin 226 is therefore determined by that of bobbin 208 and by the cone angle of the bobbins. The latter angle has been exaggerated in the drawings to facilitate illustration of the principle.

The dotted lines 228 illustrate a bobbin held by one of the elements 190 in the drum magazine and "riding" on bobbin 226 during a loading operation The disposition of the axis of bobbin 228 is determined by that of bobbin 226 and the requirement that these two bobbins make line contact while bobbin 228 rides on bobbin 226.

Finally, the hub member 188 of the drum magazine is shown. Its axis 230 is arranged parallel to the line of contact between bobbins 226 and 228. It is thus inclined to the horizontal. The inclined disposition of the magazine facilitates loading of bobbins by sliding of the bobbins in their axial direction under gravity or propulsion on a suitably oriented slide (not shown). Control of loading can therefore be effected by gates associated with the slide.

The gripper 30 must also be adapted to conical bobbins by replacement of a yoke with roller assemblies suited to cylindrical bobbins by a yoke with roller assemblies suited to the conicity of the bobbins to be gripped. For this purpose, the angle of offset of the shafts of the roller assemblies relative to the axis of the shaft is adapted to the bobbin conicity as well as to the skew required to produce the holding force F (FIG. 2).

COMPLETE DOFFING OPERATION

A complete package ejection/bobbin insertion sequence, and a complete set of equipment appropriate thereto, will vary substantially depending upon both the machine-type and the detailed design thereof. Purely by way of example, for the sake of completeness of the present specification, a complete set of equipment suitable for operating upon a specific design of open end spinning machine will be listed and very briefly described in the following.

It is assumed that the open end spinning machine is of the type in which package winding is stopped when the package has reached a predetermined length, and the cradle mechanism is operated to lift the fully-wound package through a short distance away from the friction drive roll 10. In this "lifted-off position", the package awaits the arrival of the service tender.

After being located in registry with the spinning station, the tender first operates a "cradle lift" lever which engages the arm 16 of the cradle mechanism and lifts it to its uppermost position. As already described, the cradle will be maintained in this position by the cradle mechanism of the machine. The tender then moves out a "doffing lever" which engages the underside of the package to support it. Further, the tender moves out an "upper cradle opener" which opens the cradle as described with reference to FIG. 2 in order to release the package, which is thereupon moved away from the cradle mechanism by the doff lever to a position at which the package is taken over by transport means on the machine. The doff lever is then withdrawn and the bobbin insertion arm is operated to bring a bobbin to the transfer location as described with reference to FIGS. 1 and 3. The upper cradle opener is then operated to close the cradle; this opener also exerts a grip on the lever 16 and, after closing of the cradle, forces the cradle downwardly, initially against the action of the cradle mechanism.

When the cradle has passed over the dead point of the over-centre mechanism, the upper cradle opener releases its grip on the cradle, and control of lowering of the cradle to the winding position is taken over by the cradle lift lever.

When the bobbin has been brought to the winding position, the cradle lift lever is withdrawn and the thread reserve device (FIG. 2) is moved to its initial position. A "lower cradle opener" (44, FIG. 2) is now operated to re-open the cradle, the bobbin being held in position by the gripper 30, as already described with reference to FIG. 2. The thread manipulating device 48, with its attached knife edge 52, is then moved to bring the yarn into a position ready for clamping. The further operations have already been fully described.

The expressions "cradle" and "cradle mechanism" as used in both the description and claims are not limited to a package holding device comprising a pair of arms. Alternative systems are known. In one alternative, the bobbin is held upon a "chuck" member carried by a single arm swingable to produce the arc of movement 40 shown in FIG. 1. The chuck is mounted cantilever fashion on the arm, for example as shown in U.S. Pat. No. 3,491,961. In the preferred arrangement, however, the package/bobbin is held by clamping pressure applied to its ends; any convenient means may be used for this purpose. The terms "bobbin" and "bobbin tube" used herein are intended to be synonymous. The term "doffing" as used herein refers to an operating sequence including both package ejection and fresh bobbin insertion.

FIG. 11 shows further detail of the tender shown in FIG. 7.

The axis 182 about which the sub-frame 180 can be pivoted to adapt the tender, is provided by a sub-frame mounting (not shown). The mounting is provided between subframe 180 and a cross piece 232 extending between and secured to the bulkheads 179. Cross piece 232 has a pair of curved slots 234 through which bolts can be extended to co-operate with portions of the sub-frame 180 in order to secure the sub-frame relative to the cross piece. A second cross piece 236 extends between bulkheads 179 adjacent the upper end of sub-frame 180 and is provided with a second pair of curved slots 238 for the same purpose as the slots 234.

When the securing bolts are released, sub-frame 180 can be pivoted about axis 182 with bolts moving in a corresponding manner along their respective curved slots 234 or 238. When the sub-frame 180 is in the desired position, the bolts can be re-tightened in order to hold the sub-frame relative to the cross pieces 232 and 236 for winding of a conical package of different taper.

The parts to be carried by the sub-frame 180 in a practical service tender will depend substantially upon the purpose for which the tender is designed, and in particular upon the machine with which the tender is to operate. By way of example only a complete set of equipment suitable for performing a particular type of doffing operation was described above. Each of the elements referred to in that description (i.e. the cradle lift lever, the doffing lever, the upper cradle opener, the bobbin inserting arm and the lower cradle opener) may be carried by sub-frame 180, together with a thread reserve forming mechanism where required.

However, the doff lever is preferably in the form of a "shovel" having a plate-like member adapted to engage the underside of a package to be doffed (i.e. the side facing the friction drive roller 10 shown in FIG. 1) along a substantial portion of the axial length of the package. This shovel member must maintain a substantially horizontal disposition despite tilting of the sub-frame 180 in order to adapt the tender for use with conical packages. This is because even a conical package remains in contact with a horizontally disposed friction drive roll as shown in and described with reference to FIG. 10.

Accordingly, the doff lever may be mounted on sub-frame 180 for rotation thereon about its own longitudinal axis, so that the doff lever can be pivoted back to its required horizontal disposition despite tilting of the sub-frame. Clearly, alternatively, the doff lever could be mounted separately upon the frame of the tender so that it does not tilt with the sub-frame 180. In addition to the operating elements referred to above, the sub-frame 180 will also carry certain elements, namely, a suction end finding nozzle, a yarn guide means, a yarn feed means and a yarn manipulating means. Further the yarn end finding nozzle may be mounted on the sub-frame 180 so as to permit pivoting of the end finding portion of the nozzle about the longitudinal nozzle axis relative to the sub-frame 180. In this way, the portion of the nozzle which co-operates with the package in operation can be pivoted back to the required horizontal disposition despite pivoting of the main body of the nozzle (or of the pneumatic leads extending thereto) with the sub-frame 180.

I claim:

1. A service tender for a yarn handling machine having at least one operating station for winding one of a cylindrical package and a conical package, said tender comprising a main frame; and .

a sub-frame having a plurality of operating elements mounted thereon for performing a plurality of service functions at said operating station, said sub-frame being adjustably mounted on said main frame between two positions wherein in a first of said positions said operating elements are positioned to service said station for winding of a cylindrical package at said operating station and with said sub-frame in a second of said positions said elements are positioned to service said station for winding of a conical package at said operating station.

2. A service tender as set forth in claim 1 wherein said positions are angularly spaced at an angle equal to one-half of the cone angle of a conical package being wound in said operating station.

3. A service tender as set forth in claim 1 wherein said sub-frame is pivotally mounted on said main frame on a predetermined pivot axis.

4. A service tender as set forth in claim 1 wherein said main frame includes an upper suspension and drive section for travelling on a rail past a plurality of operating stations and a lower depending section having said sub-frame mounted therein.

5. A service tender as set forth in claim 1 wherein said operating elements are pivotally mounted about a horizontal axis.

6. A service tender as set forth in claim 1 further comprising releasable means for securing said sub-frame in each of said positions.

7. In a yarn handling machine the combination comprising a cradle mechanism pivotally mounted on a first axis at at least one operating station for selectively winding of a cylindrical package and a conical package; and a service tender movably mounted relative to said operation station, said tender including a main frame, a sub-frame pivotally mounted on said main frame about a second axis to pivot between two positions, and an operating element mounted on said sub-frame to service said operating station in one of said positions to enable winding of a cylindrical package at said operating station and to service said operating station in a second of said positions to enable winding of a conical package at said operating station.

8. The combination as set forth in claim 7 wherein said second axis is co-axial to said first axis with said tender in registry with said operating station.

9. The combination as set forth in claim 7 which further comprising a friction drive roll at said operating station for winding of a yarn package in said cradle mechanism, said cradle mechanism being adjustable relative to said friction drive roll to permit winding of one of a cylindrical and a conical package in said cradle mechanism.

10. The combination as set forth in claim 7 having a plurality of operating stations, a plurality of cradle mechanisms, each said mechanism being disposed at a respective operating station and a single service tender movable along said operating stations for selective registry with each said cradle mechansim.

11. In a yarn handling machine, the combination comprising a plurality of operating stations, each said station including a cradle mechanism pivotally mounted on a first axis to pivot between two positions for selectively winding one of a cylindrical package and a conical package in a respective position; and a service tender movable along said stations for registry with a selected station, said tender including a sub-frame pivotally mounted on a second axis to move between two positions and a bobbin inserting device mounted on said sub-frame for inserting a selected one of a conical bobbin and a cylindrical bobbin into said cradle mechanism at a selected on of said two positions of said sub-frame whereby in one position of said sub-frame said inserting device is able to insert a cylindriaal bobbin into said cradle mechanism in a first of said two positions thereof and in a second position of said sub-frame said inserting device is able to insert a conical bobbin into said cradle mechanism of a registered operating station with said cradle mechanism in a second of said two positions thereof.

12. The combination as set forth in claim 11 wherein said second axis is coaxial with said first axis with said tender in registry with a selected operating station.

13. A service tender as set forth in claim 1 which further comprises bolts for securing said sub-frame on said main frame in one of a plurality of positions between said first position and said second position for winding of a conical package at said operating station.

14. The combination as set forth in claim 7 which further comprises bolts for securing said sub-frame on said main frame between said two positions to enable winding of conical packages of different taper and wherein said operating element is mounted on said sub-frame to service said operating station between said two positions to enable winding of concial packages.

* * * * *

UNITED STATES PATENT AND TRADEMARK OFFICE

CERTIFICATE OF CORRECTION

PATENT NO. : 4,606,508

DATED : August 19, 1986

INVENTOR(S) : GUNTER GARTNER

It is certified that error appears in the above-identified patent and that said Letters Patent is hereby corrected as shown below:

Column 1, line 9 "in" should be -is-
Column 1, line 9 "handing" should be -handling-
Column 3, line 11 "is" should be -in-
Column 3, line 36 "so to" should be -so as to-
Column 4, line 57 "diposition" should be -disposition-
Column 6, line 17 "to" should be -from-
Column 8, line 51 "other, detectors" should be -other detectors-
Column 9, line 68 "Section 177" should be -The upper section-
Column 10, line 22 "dottedline" should be -dotted line-
Column 15, line 21 "only a" should be -only, a-
Column 15, line 47 "180. In" should be -180. In-
Column 15, line 57 "Further the" should be -Further, the-
Column 16, line 49 "comprising" should be -comprises-
Column 16, line 61 "mechansim" should be -mechanism-
Column 17, line 7 "on" should be -one-

Signed and Sealed this

Twenty-fourth Day of February, 1987

*Attest:*

DONALD J. QUIGG

*Attesting Officer* *Commissioner of Patents and Trademarks*